US005831229A

United States Patent [19]

Chou

[11] Patent Number: 5,831,229

[45] Date of Patent: Nov. 3, 1998

[54] MECHANICAL-TYPE AUTOMATIC CIRCUIT-BREAKING APPLIANCE SWITCH ASSEMBLY

[75] Inventor: Chin-Wen Chou, Taipei, Taiwan

[73] Assignee: Shin Jiuh Corp., Taipei Hsien, Taiwan

[21] Appl. No.: 911,951

[22] Filed: Aug. 15, 1997

[51] Int. Cl.[6] ..... H01H 3/12

[52] U.S. Cl. ..... 200/16 R; 200/573

[58] Field of Search ..... 200/16 R–16 D, 200/52 A, 61.19, 61.2, 61.42, 61.41, 61.62, 61.76, 334, 341, 344, 345, 520, 530, 573, 532–535, 574

[56] References Cited

U.S. PATENT DOCUMENTS

| | | | |
|---|---|---|---|
| 3,651,289 | 3/1972 | Nagashima | 200/61.2 |
| 4,287,399 | 9/1981 | Wiechert | 200/535 |
| 4,609,795 | 9/1986 | Lavigne et al. | 200/61.19 |
| 4,616,115 | 10/1986 | Potyka | 200/573 |
| 4,982,058 | 1/1991 | Schroeder et al. | 200/61.62 |
| 5,077,454 | 12/1991 | Lorenzo | 200/573 |

*Primary Examiner*—Michael A. Friedhofer

*Attorney, Agent, or Firm*—Marshall & Melhorn

[57] ABSTRACT

A mechanical-type automatic circuit-breaking appliance switch assembly includes a switch housing, a switch unit, an elongate switch actuator and a biasing member. The switch housing is formed with a slide channel and is formed with an opening that is aligned with the slide channel. The switch unit is disposed in the switch housing adjacent to the slide channel. The switch unit has contact terminals that extend out of the switch housing, and a switch contact that faces the slide channel and that is capable of being pressed to operate the switch unit from a circuit-breaking state to a circuit-making state. The switch actuator is received in the slide channel and has first and second portions. The switch actuator is movable in the slide channel between a first position, where the second portion extends out of the switch housing via the opening and the switch actuator does not press the switch contact to operate the switch unit in the circuit-breaking state, and a second position, where the second portion extends into the switch housing via the opening and the switch actuator presses the switch contact to operate the switch unit in the circuit-making state. The biasing member is disposed in the switch housing and biases the switch actuator to the first position.

4 Claims, 2 Drawing Sheets

MECHANICAL-TYPE AUTOMATIC CIRCUIT-BREAKING APPLIANCE SWITCH ASSEMBLY

BACKGROUND OF THE INVENTION

1. Field of the Invention

The invention relates to a switch assembly, more particularly to a mechanical-type automatic circuit-breaking appliance switch assembly.

2. Description of the Related Art

Presently, electrical appliances, such as electric fans, desk lamps, heaters, stereo systems, television sets, refrigerators and computer peripheral equipments, are provided with an automatic circuit-breaking appliance switch assembly for safety purposes.

Conventional switch assemblies of the aforementioned type usually incorporate a timer that is associated with a magnetic core, an optical switch or a mercury switch to achieve the automatic circuit-breaking function. Aside from their complex design or structure and their use of components that are harmful to the environment, most conventional switch assemblies require the generation of a control signal from a timer or an optical tranceiver, and are incapable of cutting-off the supply of electrical power to an appliance in the event of a natural calamity.

It is thus desired to provide an automatic circuit-breaking appliance switch assembly which is capable of cutting-off the supply of electrical power to an appliance to prevent short circuiting and electrical fires when the latter is toppled during an earthquake, and to minimize the risk of electrocution of a child who is playing with the appliance.

SUMMARY OF THE INVENTION

The main object of the present invention is to provide a mechanical-type automatic circuit-breaking appliance switch assembly which has a simple structure and which is suitable for use with different types of electrical appliances.

Another object of the present invention is to provide a mechanical-type automatic circuit-breaking appliance switch assembly which is capable of cutting-off automatically the supply of electrical power to an appliance when the latter is toppled.

Accordingly, the mechanical-type automatic circuit-breaking appliance switch assembly of the present invention comprises:

- a switch housing formed with a slide channel and having a wall formed with an opening that is aligned with the slide channel;
- a switch unit disposed in the switch housing adjacent to the slide channel, the switch unit having contact terminals that extend out of the switch housing, and a switch contact that faces the slide channel and that is capable of being pressed to operate the switch unit from a circuit-breaking state to a circuit-making state;
- an elongate switch actuator received in the slide channel, the switch actuator having first and second portions and being movable in the slide channel between a first position, where the second portion extends out of the switch housing via the opening in the wall and the switch actuator does not press the switch contact to operate the switch unit in the circuit-breaking state, and a second position, where the second portion extends into the switch housing via the opening in the wall and the switch actuator presses the switch contact to operate the switch unit in the circuit-making state; and
- a biasing member disposed in the switch housing and biasing the switch actuator to the first position.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
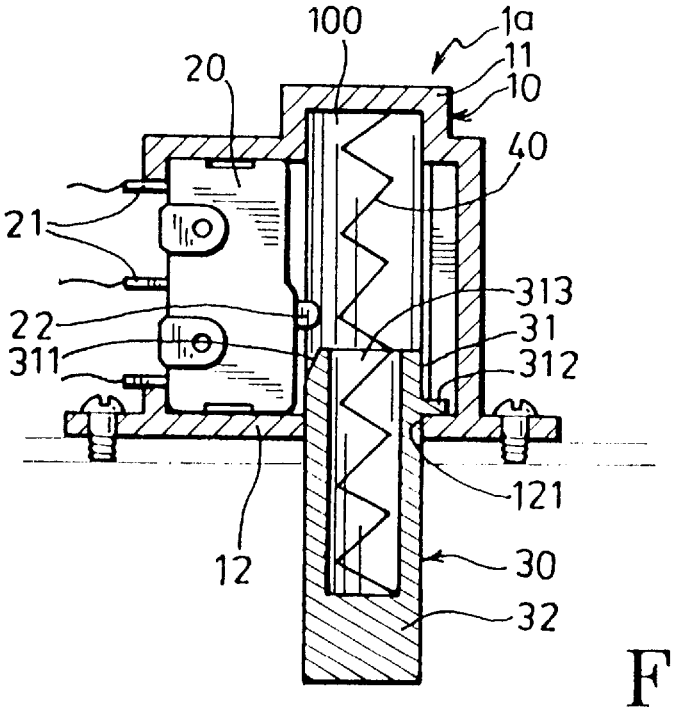
FIG. 1 a schematic sectional view of the first preferred embodiment of a mechanical-type automatic circuit-breaking appliance switch assembly according to the present invention in a circuit-breaking state.

Before the present invention is described in greater detail, it should be noted that similar elements are denoted by the same reference numerals throughout the disclosure.

Referring to FIG. 1, the first preferred embodiment of a mechanical-type automatic circuit-breaking appliance switch assembly 1*a* according to the present invention is shown to comprise a switch housing 10, a switch unit 20, a switch actuator 30 and a biasing member 40.

The switch housing 10 is adapted to be mounted inside a casing of the appliance (shown in hidden lines) and is formed with a slide channel 100 therein. In this embodiment, the switch housing 10 is mounted on a bottom wall of the casing of the appliance, and has a bottom wall 12 formed with an opening 121 that is aligned with the slide channel 100.

The switch unit 20 is disposed in the switch housing 10 adjacent to the slide channel 100. The switch unit 20 is adapted to serve as a power supply switch for the appliance, and has contact terminals 21 that extend out of the switch housing 10, and a switch contact 22 that faces the slide channel 100 and that is capable of being pressed to operate the switch unit 20 from a circuit-breaking state to a circuit-making state in a known manner.

The switch actuator 30 is formed as an elongate body which is received in the slide channel 100. In this embodiment, the switch actuator 30 has a top portion 31 formed with an inclined face 311 that is aligned with the switch contact 22 of the switch unit 20, and a transverse stop flange 312 that extends in a direction away from the switch contact 22 of the switch unit 20. The switch actuator 30 is movable in the slide channel 100 between a first position, where a bottom portion 32 of the switch actuator 30 extends out of the switch housing 10 via the opening 121 in the bottom wall 12 so as to extend out of the casing of the appliance such that the switch actuator 30 does not press the switch contact 22 to operate the switch unit 20 in the circuit-breaking state, and a second position, where the bottom portion 32 of the switch actuator 30 extends into the switch housing 10 via the opening 121 such that the switch actuator 30 presses the switch contact 22 to operate the switch unit 20 in the circuit-making state. The switch actuator 30 is further formed with a blind bore 313 which extends axially from the top portion 31 toward the bottom portion 32.

In this embodiment, the biasing member 40 is a compression spring which has a first end abutting against a top wall 11 of the switch housing 10, and a second end extending into the blind bore 313 of the switch actuator 30. The biasing member 40 biases the switch actuator 30 to the first position.

In use, when an external force is applied on the switch actuator 30, such as when the appliance is placed on the ground, and the ground forces the switch actuator 30 into the switch housing 10 against the action of the biasing member 40, the inclined face 311 at the top portion 31 of the switch actuator 30 slides past the switch contact 22 of the switch unit 20 to operate the switch unit 20 in the circuit-making state. When the applied external force on the switch actuator 30 is removed, such as when the appliance is toppled, and the ground ceases to force the switch actuator 30 into the switch housing 10, the biasing member 40 expands to force the bottom portion 32 of the switch actuator 30 to extend out of the switch housing 10. The switch actuator 30 ceases to press the switch contact 22, thereby operating the switch unit 20 in the circuit-breaking state, as shown in FIG. 1. The stop flange 312 on the top portion 31 of the switch actuator 30 limits movement of the switch actuator 30 relative to the switch housing 10 and prevents removal of the former from the switch housing 10.

Figure 2A:
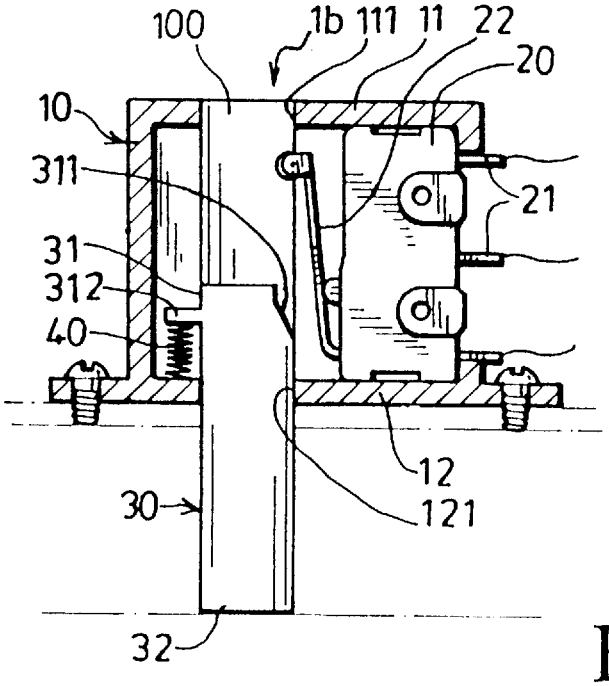
FIG. 2A is a schematic sectional view of the second preferred embodiment of a mechanical-type automatic circuit-breaking appliance switch assembly according to the present invention in a circuit-breaking state
Figure 2B:
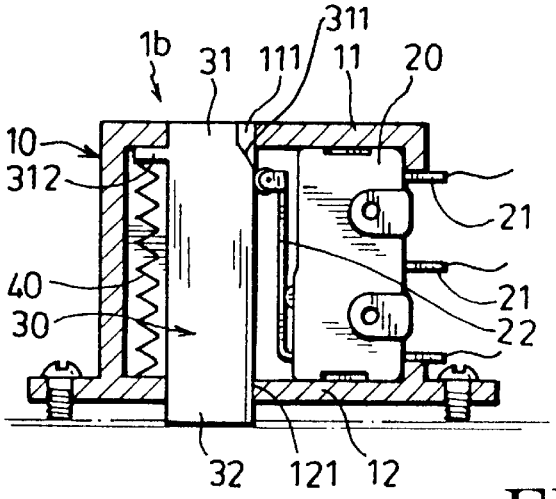
FIG. 2B is a schematic sectional view of the second preferred embodiment in a circuit-making state.

Referring to FIGS. 2A and 2B, the second preferred embodiment of a mechanical-type automatic circuit-breaking appliance switch assembly 1*b* according to the present invention is shown to comprise a switch housing 10, a switch unit 20, a switch actuator 30 and a biasing member 40.

As with the previous embodiment, the switch housing 10 is adapted to be mounted inside a casing of the appliance (shown in hidden lines) and is formed with a slide channel 100 therein. In this embodiment, the switch housing 10 has top and bottom walls 11, 12 formed with openings 111, 121 that are aligned with the slide channel 100.

The switch unit 20 is disposed in the switch housing 10 adjacent to the slide channel 100. The switch unit 20 has contact terminals 21 that extend out of the switch housing 10, and a switch contact 22 that faces the slide channel 100 and that is pressed to operate the switch unit 20 from the circuit-breaking state to the circuit-making state.

The switch actuator 30 is formed as an elongate body which is received in the slide channel 100. In this embodiment, the switch actuator 30 has a top portion 31 formed with an inclined face 311 that is aligned with the switch contact 22 of the switch unit. 20, and a transverse stop flange 312 that extends in a direction away from the switch contact 22. The switch actuator 30 is movable in the slide channel 100 between a first position, where a bottom portion 32 of the switch actuator 30 extends out of the switch housing 10 via the opening 121 in the bottom wall 12 so as to extend out of the casing of the appliance such that the switch actuator 30 does not press the switch contact 22 to operate the switch unit 20 in the circuit-breaking state, and a second position, where the bottom portion 32 of the switch actuator 30 extends into the switch housing 10 via the opening 121 such that the switch actuator 30 presses the switch contact 22 to operate the switch unit 20 in the circuit-making state.

In this embodiment, the biasing member 40 is a tension spring which has a first end connected to the stop flange 312 on the switch actuator 30 and a second end connected to the bottom wall 12 of the switch housing 10. The biasing member 40 biases the switch actuator 30 to the first position.

As shown in FIG. 2A, in use, when no external force is applied on the switch actuator 30, such as when the appliance is raised or toppled, the switch actuator 30 is pulled by the biasing member 40 such that the bottom portion 32 thereof extends out of the switch housing 10. At this time, the switch actuator 30 does not press the switch contact 22 of the switch unit 20 to operate the switch unit 20 in the circuit-breaking state. Referring to FIG. 2B, when an external force is applied on the switch actuator 30, such as when the appliance is placed on the ground, the switch actuator 30 is forced into the switch housing 10 against the action of the biasing member 40. At this time, the top portion 31 of the switch actuator 30 extends into the opening 111 in the top wall 11 of the switch housing 10, the inclined face 311 at the top portion 31 slides past the switch contact 22 of the switch unit 20, and the switch unit 20 is operated in the circuit-making state. As with the previous embodiment, the stop flange 312 on the top portion 31 of the switch actuator 30 limits movement of the switch actuator 30 relative to the switch housing 10 and prevents removal of the actuator 30 from the switch housing 10.

The embodiment of FIGS. 2A and 2B can be modified by using a compression spring for the biasing member 40 instead of a tension spring. In this case, the biasing member 40 should be disposed between the stop flange 312 on the switch actuator 30 and the top wall 11 of the switch housing 10. The operation of the modified switch assembly is similar to that of the previous embodiments and will not be detailed further.

Figure 3:
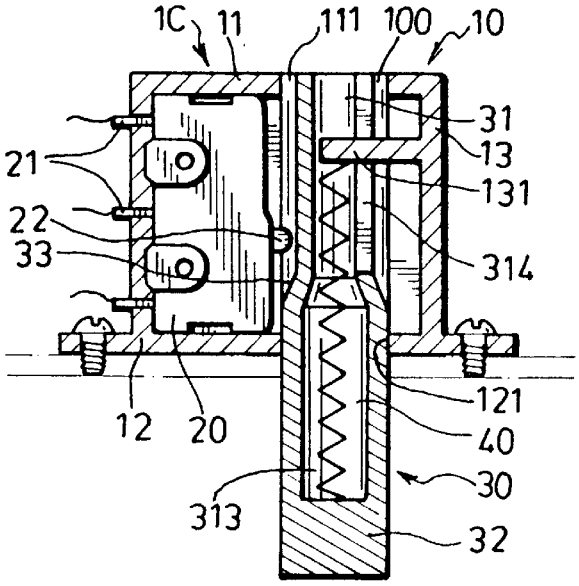
FIG. 3 is a schematic sectional view of the third preferred embodiment of a mechanical-type automatic circuit-breaking appliance switch assembly according to the present invention in a circuit-breaking state.

Referring to FIG. 3, the third preferred embodiment of a mechanical-type automatic circuit-breaking appliance switch assembly 1*c* according to the present invention is shown to comprise a switch housing 10, a switch unit 20, a switch actuator 30 and a biasing member 40.

Like the previous embodiments, the switch housing 10 is adapted to be mounted inside a casing of the appliance (shown in hidden lines) and is formed with a slide channel 100 therein. In this embodiment, the switch housing 10 has top and bottom walls 11, 12 formed with openings 111, 121 that are aligned with the slide channel 100, and a side wall 13 formed with an inward extension 131 that extends into the slide channel 100.

The switch unit 20 is disposed in the switch housing 10 adjacent to the slide channel 100 and has contact terminals 21 which extend out of the switch housing 10, and a switch contact 22 which faces the slide channel 100.

The switch actuator 30 is formed as an elongate body which is received in the slide channel 100. In this embodiment, the switch actuator 30. has a narrower top portion 31, a wider bottom portion 32 and a diverging portion 33 between the top and bottom portions 31, 32 and formed with an inclined face. The switch actuator 30 is formed with a blind bore 313 which extends axially from the top portion 31 toward the bottom portion 32. The top portion 31 is formed with an axially extending slot 314 within which the inward extension 131 on the side wall 13 of the switch housing 10 extends. The switch actuator 30 is movable in the slide channel 100 between a first position, where the bottom portion 32 of the switch actuator 30 extends out of the switch housing 10 via the opening 121 in the bottom wall 12 so as to extend out of the casing of the appliance such that the switch actuator 30 does not press the switch contact 22 to operate the switch unit 20 in the circuit-breaking state, and a second position, where the bottom portion 32 of the switch actuator 30 extends into the switch housing 10 via the opening 121 such that the switch actuator 30 presses the switch contact 22 to operate the switch unit 20 in the circuit-making state.

In this embodiment, the biasing member 40 is a compression spring which is disposed in the blind bore 313 of the switch actuator 30 and which has a first end abutting against the inward extension 131 of the switch housing 10 and a second end abutting against the switch actuator 30. The biasing member 40 biases the switch actuator 30 to the first position.

As shown in FIG. 3, in use, when no external force is applied on the switch actuator 30, such as when the appliance is raised or toppled, the switch actuator 30 is biased by the biasing member 40 such that the bottom portion 32 thereof extends out of the switch housing 10. At this time, the switch actuator 30 does not press the switch contact 22 of the switch unit 20, thereby operating the switch unit 20 in the circuit-breaking state. When an external force is applied on the switch actuator 30, such as when the appliance is replaced on the ground, the switch actuator 30 is forced into the switch housing 10 against the action of the biasing member 40. At this time, the top portion 31 of the switch actuator 30 extends through the opening 111 in the top wall 11 of the switch housing 10, the diverging portion 33 of the switch actuator 30 slides past the switch contact 22 of the switch unit 20, and the switch actuator 30 presses the switch contact 22 to operate the switch unit 20 in the circuit-making state. The inward extension 131 on the side wall 13 abuts against switch actuator 30 at one end of the slot 314 to limit movement of the switch actuator 30 relative to the switch housing 10 and prevent removal of the former from the switch housing 10 via the opening 111.

It has thus been shown that the switch assembly of the present invention involves a simple design and does not use components that are harmful to the environment. In addition, the switch assembly of this invention is suitable for use with different types of electrical appliances and is capable of cutting-off automatically the supply of electrical power to an appliance so as to prevent short circuiting and electrical fires when the latter is toppled, such as during an earthquake or when a child is playing with the appliance. The objects of the present invention are thus met.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A mechanical-type automatic circuit-breaking appliance switch assembly, comprising:

a switch housing formed with a slide channel and having a first wall formed with a first opening that is aligned with said slide channel;

a switch unit disposed in said switch housing adjacent to said slide channel, said switch unit having contact terminals that extend out of said switch housing, and a switch contact that faces said slide channel and that is capable of being pressed to operate said switch unit from a circuit-breaking state to a circuit-making state;

an elongate switch actuator received in said slide channel, said switch actuator having first and second portions and being movable in said slide channel between a first position, where said second portion extends out of said switch housing via said first opening in said first wall and said switch actuator does not press said switch contact to operate said switch unit in the circuit-breaking state, and a second position, where said second portion extends into said switch housing via said first opening in said first wall and said switch actuator presses said switch contact to operate said switch unit in the circuit-making state, said first portion of said switch actuator being formed with a transverse stop flange that extends in a direction away from said switch contact of said switch unit to limit movement of said switch actuator relative to said switch housing and to prevent removal of said switch actuator from said switch housing; and a tension spring disposed in said switch housing and biasing said switch actuator to said first position, said tension spring having a first end connected to said stop flange on said switch actuator and a second end connected to said first wall of said switch housing.

2. The mechanical-type automatic circuit-breaking appliance switch assembly according to claim 1, wherein said first portion of said switch actuator is formed with an inclined face that is aligned with said switch contact of said switch unit for sliding past said switch contact when said switch actuator moves from the first position to the second position.

3. The mechanical-type automatic circuit-breaking appliance switch assembly according to claim 1, wherein said switch housing has a second wall opposite to said first wall and formed with a second opening that is aligned with said slide channel, said first portion of said switch actuator extending into said second opening when said switch actuator is in the second position.

4. A mechanical-type automatic circuit-breaking appliance switch assembly comprising:

a switch housing formed with a slide channel and having a first wall formed with a first opening that is aligned with said slide channel;

a switch unit disposed in said switch housing adjacent to said slide channel, said switch unit having contact terminals that extend out of said switch housing, and a switch contact that faces said slide channel and that is capable of being pressed to operate said switch unit from a circuit-breaking state to a circuit-making state, said switch housing having a second wall opposite to said first wall and formed with a second opening that is aligned with said slide channel, said first portion of said switch actuator extending through said second opening when said switch actuator is in the second position; and an elongate switch actuator received in said slide channel, said switch actuator having first and second portions and being movable in said slide channel between a first position, where said second portion extends out of said switch housing via said first opening in said first wall and said switch actuator does not press said switch contact to operate said switch unit in the circuit-breaking state, and a second position, where said second portion extends into said switch housing via said first opening in said first wall and said switch actuator presses said switch contact to operate said switch unit in the circuit-making state, said second portion of said switch actuator being wider than said first portion, said switch actuator further having a diverging portion between said first and second portions and formed with an inclined face that slides past said switch contact of said switch unit when said switch actuator moves from the first position to the second position.

* * * * *